US010247054B2

(12) United States Patent
Suzuki et al.

(10) Patent No.: US 10,247,054 B2
(45) Date of Patent: Apr. 2, 2019

(54) ELECTROMAGNETIC ADJUSTING DEVICE

(71) Applicant: Kendrion (Villingen) GmbH, Villingen-Schwenningen (DE)

(72) Inventors: Tsuneo Suzuki, Mönchweiler (DE); Harald Burkart, Villingen-Schwenningen (DE); Wolfram Maiwald, Villingen-Schwenningen (DE)

(73) Assignee: Kendrion (Villingen) GmbH, Villingen-Schwenninge (DE)

( * ) Notice: Subject to any disclaimer, the term of this patent is extended or adjusted under 35 U.S.C. 154(b) by 46 days.

(21) Appl. No.: 15/519,779

(22) PCT Filed: Oct. 1, 2015

(86) PCT No.: PCT/EP2015/072672

§ 371 (c)(1),
(2) Date: Apr. 17, 2017

(87) PCT Pub. No.: WO2016/058834

PCT Pub. Date: Apr. 21, 2016

(65) Prior Publication Data

US 2017/0241301 A1 Aug. 24, 2017

(30) Foreign Application Priority Data

Oct. 17, 2014 (DE) ..... 10 2014 115 120

(51) Int. Cl.
*F01L 9/04* (2006.01)
*F01L 1/344* (2006.01)
*H01F 7/06* (2006.01)

(52) U.S. Cl.
CPC ..... *F01L 1/344* (2013.01); *H01F 7/06* (2013.01); *H01F 7/064* (2013.01);
(Continued)

(58) Field of Classification Search
CPC ..... F01L 1/344; F01L 2201/00; F01L 2001/3443; H01F 7/06; H01F 7/064; H01F 2007/062
(Continued)

(56) References Cited

U.S. PATENT DOCUMENTS 3,795,826 A 3/1974 Adey
5,592,356 A 1/1997 Ryl et al.
(Continued)

FOREIGN PATENT DOCUMENTS

CN 103649687 3/2014
DE 29521124 10/1996
(Continued)

OTHER PUBLICATIONS

Patent Cooperation Treaty, "International Search Report" and translation thereof, issued in International Application No. PCT/EP2015/072672, by European Searching Authority, document of 6 pages, dated Dec. 17, 2015.
(Continued)

*Primary Examiner* — Ching Chang
(74) *Attorney, Agent, or Firm* — Akerman LLP; Peter A. Chiabotti

(57) ABSTRACT

An electromagnetic adjusting device having a first, second and third plug contacts for operating the adjusting device on an operating voltage source having a first and second voltage pole. The device can include an actuator coupled to the plug contacts. The actuator can have a magnet coil with a first terminal connected to the first plug contact, a second terminal connected to the second plug contact, where either the first or the second plug contact is connected to the first voltage pole. The magnet coil can also have a first transistor with a first control electrode connecting the first terminal to the third plug contact, a second transistor having a second
(Continued)

control electrode connecting the second terminal to the third plug contact, a first resistor connecting the first control electrode to the second plug contact and a second resistor connecting the second control electrode to the first plug contact.

7 Claims, 1 Drawing Sheet

(52) U.S. Cl.
CPC ... *F01L 2001/3443* (2013.01); *F01L 2201/00* (2013.01); *H01F 2007/062* (2013.01)

(58) Field of Classification Search
USPC ..... 123/90.11
See application file for complete search history.

(56) References Cited

U.S. PATENT DOCUMENTS 9,343,218 B2 * 5/2016 Lamprell ..... G01D 5/2241 123/90.11
2008/0204176 A1 8/2008 Sriraksat et al.
2014/0117911 A1 5/2014 Lamprell

FOREIGN PATENT DOCUMENTS

| | | |
|---|---|---|
| DE | 10051433 | 5/2002 |
| DE | 102013105670 | 12/2014 |
| EP | 2525122 | 11/2012 |
| FR | 2145637 | 2/1973 |
| GB | 2492190 | 12/2012 |
| WO | 96/10262 | 4/1996 |
| WO | 9610262 | 4/1996 |

OTHER PUBLICATIONS

German Patnet and Trademark Office, "Office Action" and translation thereof, issued in EP 10 2014 115 120.8, document of 9 pages, dated Jun. 1, 2015.

Chinse Intellectual Property Office, "Chinese office action," and English translation thereof, issued in Chinese Patent Application No. 201580055240.4, dated Jan. 5, 2018, document of 10 pages.

* cited by examiner

ELECTROMAGNETIC ADJUSTING DEVICE

CROSS REFERENCE TO RELATED APPLICATIONS

This application is a § 371 National Phase of PCT/EP2015/072672, filed Oct. 1, 2015, the entirety of which is incorporated by reference and which claims priority to German Patent Application No. 10 2014 115 120.8, filed Oct. 17, 2014.

BACKGROUND

The application relates to an electromagnetic adjusting device having the features and structures described herein.

SUMMARY

A hydraulic camshaft phaser for an internal combustion engine of a vehicle comprises an electromagnetic adjusting device for actuating a control valve of the hydraulic cam phaser, the electromagnetic adjusting device providing at least one magnet coil including a coil core and an anchor which can slide in the axial direction of the camshaft for actuating the control valve relative to the camshaft.

Electromagnetic adjusting devices for camshaft phasers are known which provide two magnet coils for actuating the control valve. Furthermore electromagnetic adjusting devices providing only one single magnetic coil are known as well.

For controlling adjusting devices for camshaft phasers by means of a motor control device said adjusting devices are equipped with a plug via which the adjusting device can be connected to the motor control system. When used for an adjusting device with two magnet coils said plug is required to provide at least three plug contacts for connecting the two magnet coils, as is shown diagrammatically in FIG. 3.

Said FIG. 3 shows an electromagnetic adjusting device 100 for camshaft phasers comprising two magnet coils M1 and M2 of an actuator wherein each of these magnet coils has a first and a second terminal A11 and A22 or A21 and A22. The two magnet coils M1 and M2 are connected in series inside the adjusting device 100. That way the first terminal A11 of the first magnet coil M1 is wired on a first plug contact K11; the second terminal A12 is joined with the second terminal A22 of the second magnet coil M2, forming a third plug contact K13. The first terminal A21 of the second magnet coil M2 forms the second plug contact K12. For the series circuit of the two magnet coils M1 and M2 receiving a flow of current, the positive pole of an operating voltage source is applied either to the first plug contact K11 or to the second plug contact K12 whereas the negative pole of the operating voltage is applied to the third plug contact K13. As the case may be, these plug contacts K11, K12 and K13 form a plug SK of this adjusting device 100 along with other plug contacts. Depending on whether the positive pole of the operating voltage source is applied to the first or the second plug contact K11 or K12 a different direction of the flora of current through the two magnet coils M1 and M2 is set.

An adjusting device having only one single magnet coil, however, requires only two plug contacts. This is apparent from an adjusting device 10 represented diagrammatically in FIG. 2 having one single magnet coil M of an actuator comprising a first terminal A and a second terminal B which are each joined to a plug contact K1 and K2. As the case may be, these two plug contacts form a plug S of the adjusting device 10 along with other plug contacts.

Compared to the adjusting device 100 the adjusting device 10 requires one less plug contact. Therefore the respective matching socket needs to be provided, depending on the adjusting device. There is no "plug compatibility" between these two embodiments of the adjusting devices 10 and 100.

Therefore the present disclosure further refines the electromagnetic adjusting device initially mentioned such that a plug may be used which is compatible to the plug of an electromagnetic adjusting device comprising two magnet coils.

The present application provides an electromagnetic adjusting device having the features and structures disclosed herein.

Such an electromagnetic adjusting device having an actuator comprising a single magnet coil and comprising plug contacts for operating the adjusting device on an operating voltage source having a first and second voltage pole is characterized according to the present disclosure in that

- a first terminal of the magnet coil is connected to a first plug contact,
- a second terminal of the magnet coil is connected to a second plug contact, wherein either the first or the second plug contact is connected to the first voltage pole,
- a first transistor element having a control electrode is provided and connects the first terminal of the magnet coil to a third plug contact,
- a second transistor element having a control electrode is provided and connects the second terminal of the magnet coil to the third plug contact,
- the control electrode of the first transistor element is connected via a first resistance element to the second plug contact and
- the control electrode of the second transistor element is connected via a second resistance element to the first plug contact.

This array according to the present disclosure, having a single magnet coil and the two transistor elements represents an H circuit which on one hand enables the implementation of two directions of the flow of current through the single magnet coil and on the other that three plug contacts are created as in the case of an adjusting device having two magnet coils. Thus, it is possible to provide a plug which is compatible to a plug for an adjusting device having two magnet coils by means of this H circuit and the three plug contacts created thereby.

According to an advantageous design of the present disclosure, the first terminal of the magnet coil is connected to the first plug contact via a first reverse polarity protection diode and the second terminal of the magnet coil is connected to the second plug contact via a second reverse polarity protection diode.

The electromagnetic adjusting device, according to the present disclosure, is suitable for being used for a camshaft adjustment of an internal combustion engine of a vehicle.

BRIEF DESCRIPTION OF THE DRAWINGS

The subject matter of the present application is described below in detail according to an embodiment with reference to the accompanying figures in which.

DETAILED DESCRIPTION

Figure 2:
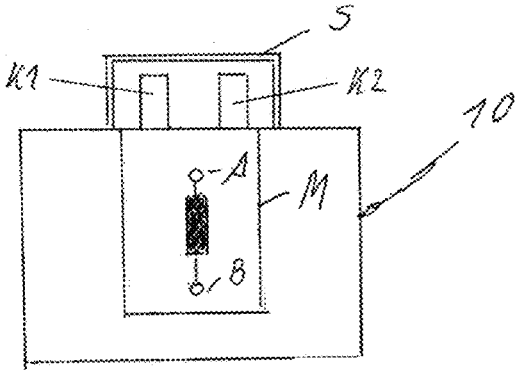
Fig. 2 (Prior art)
FIG. 2 is a diagrammatic view of an electromagnetic adjusting device for a camshaft phaser of an internal combustion engine having a single magnet coil according to the prior art and FIG. 3 is a diagrammatic view of an electromagnetic adjusting device for a camshaft phaser of an internal combustion engine having two magnet coils according to the prior art.
Figure 3:
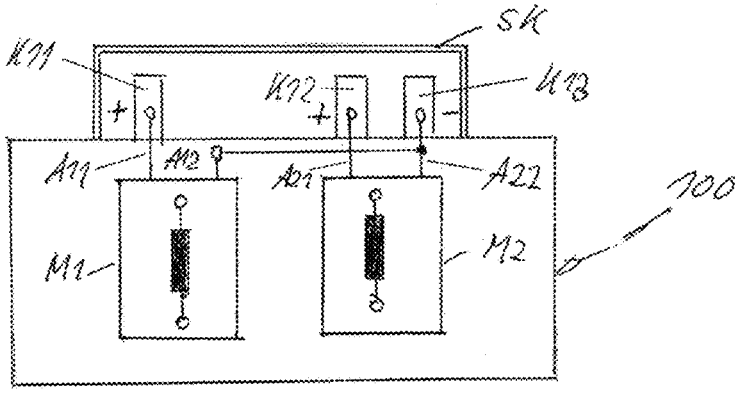
Fig. 3 (Prior art)

The two FIGS. 2 and 3 have already been described in the introduction to the description; reference is made hereto, where appropriate.

Figure 1:
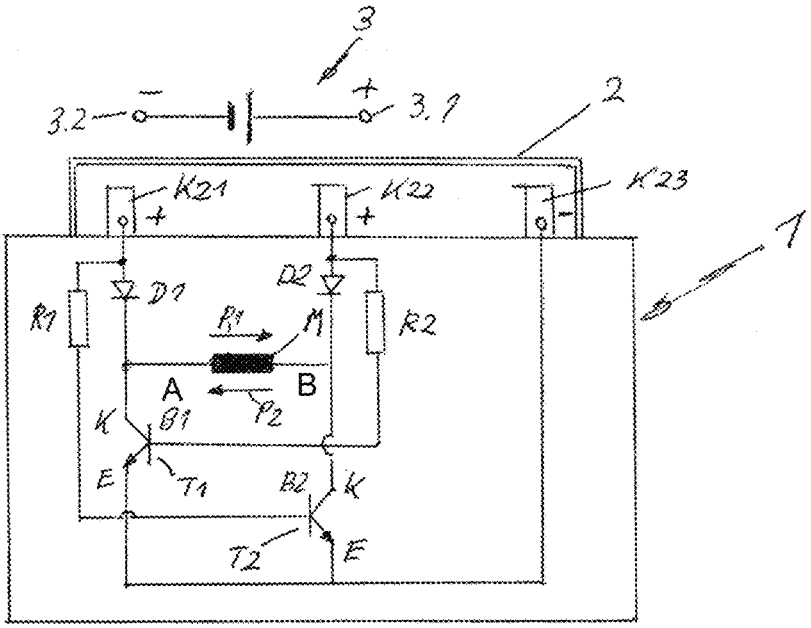
FIG. 1 is a diagrammatic view of an electromagnetic adjusting device having a magnet coil which is interconnected in an H circuit according to the present disclosure.

FIG. 1 shows according to FIG. 2 an electromagnetic adjusting device 1 for a hydraulic camshaft phaser. This electromagnetic adjusting device 1 comprises an actuator having a single magnet coil M comprising a first terminal A and a second terminal B. Said magnet coil M is interconnected in an H circuit and connected to three plug contacts K21, K22 and K23 which are forming a plug 2 with other plug contacts, where appropriate. The difference to the electromagnetic adjusting device 10 according to FIG. 2 is that there the magnet coil M is interconnected with only two plug contacts K1 and K2 whereas in the case of the magnet coil according to FIG. 1 three plug contacts K21, K22 and K23 are available for the magnet coil M.

According to FIG. 1 the first terminal A of the magnet coil M is connected via a first reverse polarity protection diode D1 to the first plug contact K21 whereas the second terminal B of the magnet coil B is connected via a second reverse polarity protection diode to the second plug contact K22.

Furthermore the H circuit comprises a first transistor element T1 as well as a second transistor element T2, wherein the first transistor element T1 connects the first terminal A of the magnet coil M to the third plug contact K23 via its collector-emitter path. In the same way the second transistor element T2 is connecting the second terminal B of the magnet coil M to the third plug contact K23, the collector K of the second transistor element T2 being connected to the second terminal B of the magnet coil M and the emitter B of the second transistor element T2 being connected to the third plug contact K23.

The base electrode B2 of the second transistor element 12 is connected via a first resistance element R1 to the first plug contact K21, whereas the base electrode B1 of the first transistor element T1 is wired via a second resistance element R2 to the second plug contact K22.

FIG. 1 also displays diagrammatically an operating voltage source 3 having a first voltage pole 3.1, the positive pole, and a second voltage pole 3.2, the negative pole. The positive pole 3.1 is connected either to the first plug contact K21 or to the second plug contact K22, whereas the third plug contact K23 is connected to the negative pole 3.2.

If the first plug contact K21 is applied to the positive pole 3.1 of the operating voltage source 3, the magnet coil M is receives a flow of current in the direction of the arrow P1. If, however, the second plug contact K22 is applied to the positive pole 3.1 of the operating voltage source 3 the magnet coil P1 receives a flow of current in the inverse direction, that is, in the direction of the arrow P2. That way an anchor of the actuator can be moved by means of the magnet coil M into opposite directions.

The invention claimed is:

1. An electromagnetic adjusting device comprising:

an actuator comprising a single magnet coil;

a first plug contact, a second plug contact and a third plug contact for operating the adjusting device on an operating voltage source having a first voltage pole and a second voltage pole;

wherein a first terminal of the magnet coil is connected to the first plug contact;

wherein a second terminal of the magnet coil is connected to the second plug contact, wherein either the first or the second plug contact is connected to the first voltage pole;

wherein the third plug contact is connected to the second voltage pole;

wherein a first transistor element having a first control electrode connects the first terminal of the magnet coil to the third plug contact;

wherein a second transistor element having a second control electrode connects the second terminal of the magnet coil to the third plug contact;

wherein the first control electrode of the first transistor element is connected via a first resistance element to the second plug contact; and wherein the second control electrode of the second transistor element is connected via a second resistance element to the first plug contact.

2. The electromagnetic adjusting device according to claim 1, wherein the first terminal of the magnet coil is connected via a first reverse polarity protection diode to the first plug contact; and wherein the second terminal of the magnet coil is connected via a second reverse polarity protection diode to the second plug contact.

3. The electromagnetic adjusting device according to claim 1, configured for use with a camshaft adjustment of an internal combustion engine of a vehicle.

4. An electromagnetic adjusting device comprising:

a first plug contact, a second plug contact and a third plug contact for an actuator with a single magnet coil, the actuator for operating the adjusting device of a camshaft of an internal combustion engine of a vehicle on an operating voltage source having a first voltage pole and a second voltage pole;

wherein a first terminal of the magnet coil is connected to the first plug contact; wherein a second terminal of the magnet coil is connected to the second plug contact;

wherein either the first or the second plug contact is connected to the first voltage pole;

wherein the third plug contact is connected to the second voltage pole;

wherein a first transistor element having a first control electrode connects the first terminal of the magnet coil to the third plug contact;

wherein a second transistor element having a second control electrode connects the second terminal of the magnet coil to the third plug contact;

wherein the first control electrode of the first transistor element is connected via a first resistance element to the second plug contact; and wherein the second control electrode of the second transistor element is connected via a second resistance element to the first plug contact.

5. The electromagnetic adjusting device according to claim 4, wherein the first terminal of the magnet coil is connected via a first reverse polarity protection diode to the first plug contact; and wherein the second terminal of the magnet coil is connected via a second reverse polarity protection diode to the second plug contact.

6. An electromagnetic adjusting device, comprising:

a plurality of plug contacts for operating the adjusting device of a vehicle camshaft on an operating voltage source having a first voltage pole and a second voltage pole;

an actuator coupled to a first plug contact, a second plug contact and a third plug contact of the plurality of plug contacts, the actuator having a magnet coil, the magnet coil comprising:

a first terminal connected to the first plug contact;

a second terminal connected to the second plug contact, wherein either the first or the second plug contact is connected to the first voltage pole and wherein the third plug contact is connected to the second voltage pole;

a first transistor with a first control electrode connecting the first terminal of the magnet coil to the third plug contact;

a second transistor having a second control electrode connecting the second terminal of the magnet coil to the third plug contact;

a first resistor connecting the first control electrode to the second plug contact;

a second resistor connecting the second control electrode to the first plug contact.

7. The electromagnetic adjusting device according to claim 6, further comprising:

a first reverse polarity protection diode connecting the first terminal of the magnet coil to the first plug contact; and a second reverse polarity protection diode connecting the second terminal of the magnet coil to the second plug contact.

* * * * *